US005381652A

United States Patent [19]

Mezzedimi et al.

[11] Patent Number: 5,381,652

[45] Date of Patent: Jan. 17, 1995

[54] COMBUSTION SYSTEM WITH LOW POLLUTANT EMISSION FOR GAS TURBINES

[75] Inventors: Vasco Mezzedimi, Poggibonsi; Luciano Bonciani, Florence; Gianni Ceccherini, Sesto Fiorentino; Roberto Modi, Borgo San Lorenzo, all of Italy

[73] Assignees: Nuovopignone, Florence; Eniricerche S.p.A., Milan, both of Italy

[21] Appl. No.: 122,381

[22] Filed: Sep. 16, 1993

[30] Foreign Application Priority Data

Sep. 24, 1992 [IT] Italy ..... MI 92/ A/002189

[51] Int. Cl.[6] ..... F02C 9/00; F23R 3/26

[52] U.S. Cl. ..... 60/39.23; 60/737; 60/746; 60/748

[58] Field of Search ..... 60/39.23, 733, 737, 60/746, 748, 760; 431/12, 352, 353, 243

[56] References Cited

U.S. PATENT DOCUMENTS

| | | | |
|---|---|---|---|
| 3,486,834 | 12/1969 | Frey et al. | 431/12 |
| 3,731,484 | 5/1973 | Jackson et al. | 60/39.23 |
| 3,927,958 | 12/1975 | Quinn | 431/353 |
| 3,958,413 | 5/1976 | Cornelius et al. | 60/39.06 |
| 3,958,416 | 5/1976 | Hammond, Jr. et al. | 60/39.23 |
| 4,420,929 | 12/1983 | Jorgensen et al. | 60/733 |
| 4,545,196 | 10/1985 | Mongia et al. | 60/39.32 |
| 4,813,867 | 3/1989 | Yoshida et al. | 431/353 |
| 4,815,966 | 3/1989 | Janssen | 431/352 |
| 4,982,570 | 1/1991 | Waslo et al. | 60/733 |
| 5,003,768 | 4/1991 | Kappler et al. | 60/39.23 |

FOREIGN PATENT DOCUMENTS

| | | | |
|---|---|---|---|
| 243407 | 11/1965 | Austria | 431/353 |
| 239020 | 9/1987 | European Pat. Off. . | |
| 269824 | 6/1988 | European Pat. Off. . | |
| 488766 | 6/1992 | European Pat. Off. . | |
| 58-072822 | 4/1983 | Japan . | |
| 890054 | 4/1962 | United Kingdom | 60/746 |
| 2034874 | 6/1980 | United Kingdom | 60/757 |
| 2073399 | 10/1981 | United Kingdom . | |

*Primary Examiner*—Timothy S. Thorpe
*Attorney, Agent, or Firm*—Morgan & Finnegan

[57] ABSTRACT

A combustion system with low pollutant emission, of the pre-mixing type for gas turbines, in which the combustion air passes from the interspace to the pre-mixing chamber via apertures in this latter, their degree of opening being varied, in accordance with the fuel quantity used, by corresponding apertures in a rotatable drum, and in which a series of small holes fed with additional fuel is provided in the interspace. Further flame stabilization expedients and differential cooling of the combustion chamber are also provided.

5 Claims, 1 Drawing Sheet

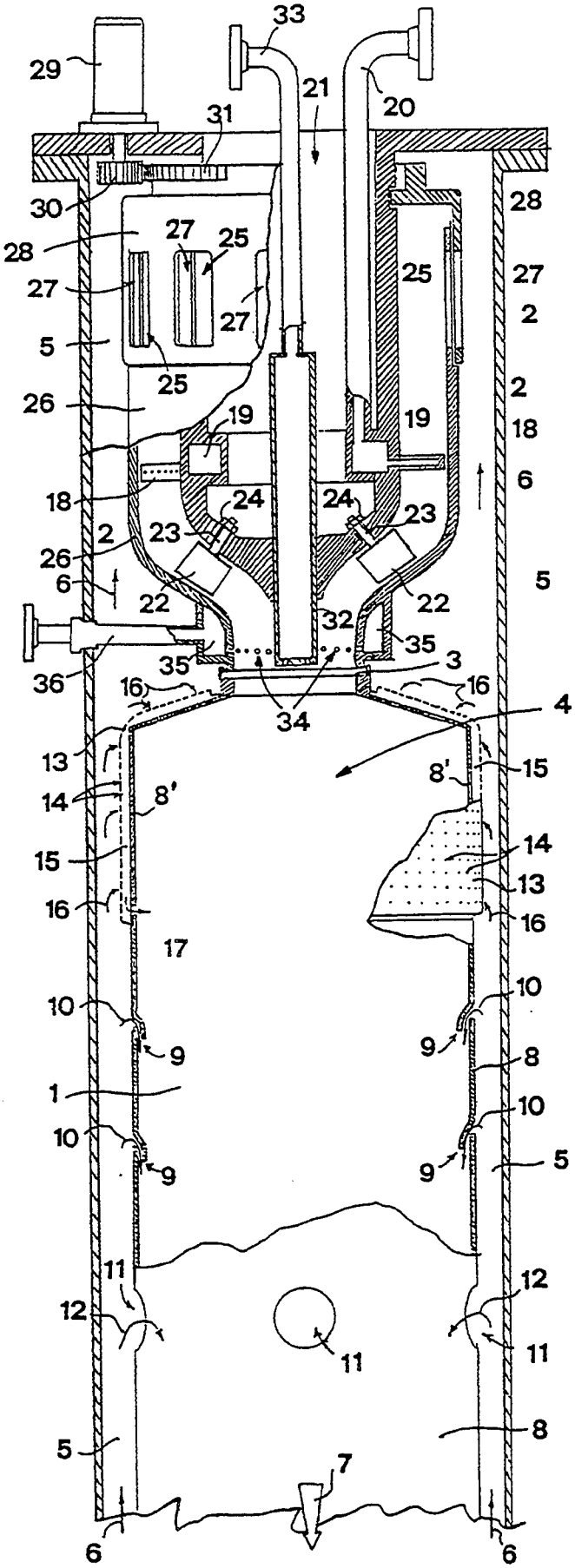
33
29
21
20
31
30
28
27
25
27
5
25
26
19
19
18
24
24
23
23
2
26
6
22
22
32
35
35
3
36
16
16
34
4
13
8'
15
14
8'
14
15
13
16
16
17
10
10
9
9
8
1
10
10
9
9
5
11
12
12
11
11
8
5
7
6
6

COMBUSTION SYSTEM WITH LOW POLLUTANT EMISSION FOR GAS TURBINES

FIELD OF THE INVENTION

This invention relates to a combustion system for gas turbines which provides efficient and precise combustion air control on the basis of the turbine loading, ensures permanent flame stability, prevents the cooling air interfering in any way with the combustion and imposes a more or less accentuated rotary movement on the air-fuel mixture, hence minimizing pollutant nitrogen oxide and carbon monoxide emission at all turbine loading levels.

BACKGROUND OF THE INVENTION

The formation of pollutant nitrogen oxides is known to increase with increasing combustion or flame temperature.

In the usual known combustion systems of the so-called diffusion type in which the fuel is injected into a combustion chamber surrounded by an interspace containing pressurized air flowing counter-currently to the stream of combustion products and comprising holes for the combustion air, small intermediate apertures distributed over the entire chamber surface for the chamber cooling air and holes for the dilution air which reduces the temperature of the combustion products to a level acceptable by the turbine, the fuel burns an air quantity always equal to the stoichiometric value and hence always with a high energy concentration and a high temperature whatever the excess air present, and hence without consequent flame stability problems even under low load, but with evident high pollutant emission. In order to reduce this pollutant emission, use is generally made of combustion systems with pre-mixing in which upstream of the combustion chamber, from which it is separated by a constriction and which is also surrounded by said interspace containing pressurized air, there is provided a pre-mixing chamber into which both the fuel and said combustion air are fed, these mixing at low temperature to substantially dilute the fuel before reaching the combustion chamber, so that said combustion is no longer stoichiometric but instead takes place with an excess of air and hence at a lower temperature.

It has now been found that to achieve low pollutant emission of nitrogen oxides and carbon monoxide together with good flame stability it is necessary to maintain the combustion air/fuel ratio around an optimum value corresponding to an air excess of between 1.5 and 2 times the stoichiometric value, this being achievable with pre-mixing combustion systems at all turbine loading levels.

In this respect, whereas the air flow fed to said combustion systems generally by an axial compressor remains substantially constant, the fuel quantity has to be varied continuously on the basis of the turbine loading, so that if said optimum air excess is achieved at full load, it is no longer achieved when the turbine is used at reduced load, i.e. when using a smaller fuel quantity. In such cases the air excess can reach between 4 and 7 times the stoichiometric value, with the consequent danger of the flame extinguishing.

In addition to the said possible extinguishing of the flame, a further drawback of pre-mixing combustion systems is that they easily produce unstable combustion due to the fact that the low energy concentration present makes the flame sensitive to the smallest disturbances, hence producing deleterious pressure pulsation within the combustion chamber.

SUMMARY OF THE INVENTION

The object of the present invention is to obviate the aforesaid drawbacks by providing a combustion system of pre-mixing type which maintains the combustion air/fuel ratio substantially constant at its optimum value at all turbine loading levels and always ensures flame presence and stability, with consequent minimizing of pollutant emission.

This is substantially attained in that the combustion air path from the interspace into the pre-mixing chamber via apertures provided in the outer surface of this latter is interrupted by a valving member consisting in practice of a drum rotatable on said outer surface of the pre-mixing chamber and provided with corresponding apertures arranged to cooperate with said apertures in the pre-mixing chamber, said drum being driven by an actuator, the pinion of which engages a gear sector rigid with the drum so as to vary the degree of opening of said corresponding apertures on the basis of the fuel quantity used.

In this manner, depending on the angular position of the valving drum and hence of its apertures relative to the apertures of the pre-mixing chamber, these latter can be either completely open or their degree of opening reduced until total closure is achieved. Hence when the turbine is to operate at reduced load and thus with less fuel, it is necessary merely to conveniently reduce the degree of opening of said apertures to appropriately reduce the air to its optimum value to achieve low pollutant emission, because in this manner a restriction is created at the apertures so that instead of passing through this restriction the air prefers to enter the combustion chamber through the dilution air holes.

The surface or the constriction which joins the pre-mixing chamber to the combustion chamber, and downstream to which the flame develops, is provided with a series of small holes for additional injection of fuel, which creates a fuel-rich front in the flame region and hence makes the flame stable.

Hence, the combustion system for gas turbines, comprising a combustion chamber provided with small apertures distributed over the entire chamber surface tot the chamber cooling air and with holes for the dilution air which reduces the temperature of the combustion products leaving the chamber, this being surrounded by an interspace containing pressurized air flowing counter-currently to the stream or said combustion products, which interspace also surrounds a pre-mixing chamber in which the fuel is mixed with the combustion air and which is positioned upstream of said combustion chamber and separated therefrom by a constriction, is characterised according to the present invention in that said combustion air is taken from said interspace via a series of apertures provided in the outer surface to said pre-mixing chamber and cooperating with corresponding apertures in a drum rotatable on said outer surface of the pre-mixing chamber, said drum being driven, to vary the degree of opening of said corresponding apertures in accordance with the fuel quantity used, by an actuator the pinion of which engages a gear sector field with the drum, and in that the surface of said constriction is provided with a series of small holes fed with additional fuel.

Furthermore, in order to facilitate more effective and homogeneous mixing, according to a preferred embodiment of the present invention said pre-mixing chamber has an annular cross-section smoothly blending into said separating constriction and comprises in its annular interior a radial series of perforated tubes fed with the fuel to be mixed.

The combustion system of the present invention also comprises further flame stabilizating expedients, to be used, under certain conditions, instead of or together with the additional fuel injection through the small holes in the constriction.

One of these expedients consists of a central burner positioned within said pre-mixing chamber and fed with additional fuel to effect further fuel injection into the the combustion zone downstream of said constriction.

The other expedient comprises a series of blades previously set at a predetermined adjustable angle to the air-fuel mixture stream within the annular interior of said pre-mixing chamber in proximity to said constriction.

In this manner, rotary motion is impressed on the mixture within the annular chamber to a greater or lesser extent depending on the blade angle, this having a beneficial effect on flame stability.

Finally it is believed, as experimental tests would seem to confirm, that the presence of cooling air within the combustion zone immediately downstream of the constriction can disturb the combustion and in particular result in an increase in carbon monoxide, according to a further characteristic of the present invention the combustion chamber is cooled in a differential manner, in that that part of the combustion chamber surface in correspondence with the combustion zone downstream of the constriction is no longer provided with distributed small apertures for the cooling air, but instead is without apertures, and together with an outer wall provided with a large number of small holes close together defines a small cooling chamber which communicates with the combustion chamber via collector holes provided in that end of said small chamber further from said constriction.

In this manner, the air which enters said small chamber under pressure from the interspace by passing through said small holes in the outer wall creates a number of air blasts against the inner wall of the small chamber and hence against the surface of the combustion chamber, which effectively cool it to then flow into the combustion chamber but at such a distance away as not to be able to influence the combustion zone.

The invention is described in detail hereinafter with reference to the accompanying drawing, which shows a preferred embodiment thereof by way of non-limiting only, in that technical or constructional modifications can be made thereto but without leaving the scope of the present invention. For example, instead of using a pinion engaging a gear sector, said drum can be driven by any other drive system.

BRIEF DESCRIPTION OF THE DRAWING

The sole figure represents a multi-sectional side view of a gas turbine combustion system formed in accordance with the invention.

DETAILED DESCRIPTION OF THE INVENTION

In the figure, the reference numeral 1 indicates the combustion chamber of a gas turbine combustion system, having its upstream end connected to a pre-mixing chamber 2 via a constriction 3, immediately downstream of which there is the actual combustion zone 4 of the chamber 1. The entire assembly is surrounded by an interspace 5 containing air fed under pressure by an axial compressor, not shown in the figure, and flowing in the direction of the arrows 6, i.e. counter-currently to the stream 7 of combustion products leaving the combustion chamber 1.

The outer surface 8 of the combustion chamber 1 is provided with small deflector apertures 9 for the chamber cooling air 10 and, in the downstream part of the chamber, with holes 11 for air 12 used to dilute the combustion products in order to reduce their temperature to a level acceptable to the turbine. That part 8' of the surface 8 of the combustion chamber 1 surrounding the combustion zone 4 is without apertures 9, and together with an outer wall 13 provided with a large number of small holes 14 positioned close together defines a small cooling chamber 15. In this respect, the pressurized air 16 passing through said small holes 14 generates a large number of air blasts against the surface 8', which is hence effectively cooled without the cooling air 16 being able to influence the combustion zone 4 in any way as said air is made to flow into the combustion chamber 1 through collector holes 17 (only one is visible in the figure) provided in that end of the small chamber 15 further from the constriction 3. Said pre-mixing chamber 2 has an annular cross-section smoothly blending into the interspace 3 and comprises in its annular interior a radial series of perforated tubes 18 which are fed with the fuel to be mixed via the annular chamber 19 and the pipe 20 passing through the central cavity 21 in the pre-mixing chamber 2. In said annular interior 2 in proximity to the interspace 3 there are also provided blades 22 which by means of the pin 23 and fixing nut 24 can be set at a predetermined angle to the air-fuel mixture stream to impress a more or less accentuated rotary movement on the mixture to favour flame stabilization.

The combustion air is conveyed from the interspace 5 into the pre-mixing chamber 2 via a series of apertures 25 provided in the outer surface 26 of said chamber. Said apertures 25 cooperate with corresponding apertures 27 in a drum 28 which is rotatable on said outer surface 26 and is rotated in such a manner as to vary the degree of opening of said apertures 25 in accordance with the quantity of fuel used. The drum 28 is rotated by an actuator 29, the pinion 30 of which engages a gear sector 31 rigid with the drum 28.

The figure also shows a central burner 32 inserted into said central cavity 21 and fed with additional fuel via the pipe 33, to inject further fuel into the combustion zone 4 to maintain the flame stable.

Finally, to achieve effective flame stabilization the surface of the interspace 3 is provided with a series of small holes 34 fed with additional fuel via the annular chamber 35 and pipe 36.

We claim:

1. A combustion system for gas turbines, comprising:

1) a premixing chamber for mixing fuel, said premixing chamber having inner and outer walls that form an annular premixing zone therebetween, said annular premixing zone having a linearly extending portion of substantially uniform cross-section and a gradually tapered portion that terminates into a constricted outlet opening, adjustable flow means located in said annular premixing zone at said tapered portion to provide rotary movement to gases flowing through said annular premixing zone, and a plurality of apertures located in an upper portion of said outer wall;

2) an apertured rotatable drum circumscribing said upper portion of said outer wall, apertures in said rotatable drum and in said upper portion of said outer wall cooperating with one another whereby aperture flow area for feeding air into said premixing chamber may be adjusted in response to a pinion of an actuator associated with a gear sector fixedly mounted on said rotatable drum;

3) a combustion chamber having an upper wall section with a constricted inlet end and a downstream mid wall section containing deflector openings for air, said downstream mid wall section being coterminous with a bottom wall section having an outlet end for emitting combustion product, said bottom wall section containing dilution air openings to permit dilution air to enter said bottom section upstream of said outlet end of said combustion chamber to reduce the temperature of the combustion products leaving the combustion chamber;

4) an outer housing wall circumscribing and spaced from said outer wall of premixing chamber and said combustion chamber to form an interspace, said interspace extending above an uppermost end of said premixing chamber; and 5) means for feeding pressurized air along said interspace in a direction countercurrent to combustion products emanating from said premixing and combustion chambers.

2. A combustion system according to claim 1, wherein a plurality of radial disposed perforated tubes for feeding fuel are disposed within said annular premixing zone upstream of said tapered portion.

3. A combustion system according to claim 1, further including a central burner positioned within said premixing chamber for injecting additional fuel downstream of said constricted outlet of said premixing chamber.

4. A combustion system according to claim 1, wherein said outer wall of said premixing chamber has a plurality of additional apertures circumscribing said constricted outlet end that communicate with an annular chamber for feeding additional fuel into said constricted outlet end in a radially inward direction.

5. A combustion system according to claim 1, wherein said upper wall section of said combustion chamber is formed from (1) an inner member that is substantially imperforate along a substantial portion thereof and with inlet openings only at a bottom end thereof, and (2) an outer perforated member spaced from said inner member and forming an annular chamber therebetween, air from said interspace traversing perforations in said outer member and flowing into said combustion chamber in a radially inward direction.

* * * * *